US005774052A

United States Patent [19]

Hamm et al.

[11] Patent Number: 5,774,052

[45] Date of Patent: Jun. 30, 1998

[54] MONITORING AND ALERTING SYSTEM FOR BUILDINGS

[75] Inventors: Dennis Hamm; David P. Kimmich, both of Pasadena, Calif.

[73] Assignee: Pacific Bank Technology, Inc., Pasadena, Calif.

[21] Appl. No.: 598,338

[22] Filed: Feb. 8, 1996

[51] Int. Cl.[6] ..... G08B 21/00

[52] U.S. Cl. ..... 340/540; 340/641; 340/642; 340/825.06; 340/825.35

[58] Field of Search ..... 340/540, 642, 340/641, 825.06, 825.35; 235/379, 381

[56] References Cited

U.S. PATENT DOCUMENTS

| | | | |
|---|---|---|---|
| 4,354,181 | 10/1982 | Spletzer | 340/642 |
| 5,057,814 | 10/1991 | Onan et al. | 340/642 |
| 5,061,997 | 10/1991 | Rea et al. | 340/825.06 |
| 5,091,713 | 2/1992 | Horne et al. | 340/825.35 |
| 5,471,201 | 11/1995 | Cerami et al. | 340/641 |

*Primary Examiner*—Brent A. Swarthout
*Assistant Examiner*—John Tweel, Jr.
*Attorney, Agent, or Firm*—Wagner, Middlebrook & Kimbell

[57] ABSTRACT

A system is disclosed for sensing selected conditions particularly for an unoccupied commercial business and taking the appropriate action. Corrective action may include shutting down a system, sending a signal to an occupied location for evaluation of the selected abnormal condition, making a record of the abnormal condition for rectification at a later time. The system includes one or more light level sensors directed to observe the light level at a selected location, a CPU or controller which stores data representing acceptable light levels and a schedule. If the light level at the selected area does not reach or maintain the desired light level, corrective action is taken. If the commercial establishment is a bank and the light level is at an ATM (automatic teller machine) the system may temporarily shut the ATM machine down and illuminate a sign to indicate that the ATM is not open. If the sensor is directed toward or monitors non-essential lighting, for example, signs, it may merely record the insufficiency in lighting and produce a record for later correction of the condition. If the condition sensed is a different type of discrepancy, failure of heating, water leak detection or other emergency, the system includes a modem and telephone communications link to a human monitoring station for instantaneous alerting and to allow corrective action.

15 Claims, 8 Drawing Sheets

INITIATE C.P.U
TO FIG. 8a
SET LIGHT LEVEL 1
SET LIGHT LEVEL 2
SET LIGHT LEVEL ---N
REPORT TO OFFSITE COMPUTER
SET TIME CYCLE
REPORT TO MODEM
MONITOR AMBIENT LEVEL
NO
AMBIENT LOW
YES
C.P.U ALERTED
REPORT TO LOG IN C.P.U.
LEVEL 1 OK
NO
YES
LEVEL 2 OK
ILLUMINATE "ATM CLOSED"
YES
NO
LEVELS ---N OK
NO

MONITORING AND ALERTING SYSTEM FOR BUILDINGS

BACKGROUND OF THE INVENTION

In recent years there has been growing sophistication and automation in business and in particular in the banking field. There has been a continuous sequence of changes in this particular field including expansion of branch banking with centralization of accounting, consolidation and merger of banking organizations, reduction of the number and change of location of branch banks and, particularly, the introduction of the automatic teller machines (ATM) at most branches and other remote locations. There has been, likewise, great expansion of the use of ATM and credit card transactions in place of conventional printed checks. The movement toward a checkless society appears on the horizon.

The branch bank has become a satellite facility for the central or main branch and must attempt to be a full service banking facility even though having a small number of employees. The trend also has been to employ part time employees for most customer activities.

The branch bank itself often is a freestanding building or end section of a shopping center or strip mall. It is intended to provide full banking services and to be self sufficient from the facilities and security standpoint. It may rely upon wired security signalling to a local police department or security company. The facility is not usually occupied during the nighttime hours.

The ATM installation has added round the clock service to customers in allowing them to make deposits or withdrawals at any time of the day or night without the use of the traditional night deposit lockbox which has been used by merchants for years. The individual customer now has the benefit of off hour banking including withdrawals.

The expansion of the ATM has given rise to a new type of crime in which a criminal observes a likely victim at an ATM machine and through brute force or by observing and recording the personal identification number (PIN) of the user can gain access to the person's account. The installation of ATMs at branch banks and remote locations has given rise to municipal and statewide requirements that the banking facility provide adequate lighting around such machines to deter would-be criminals and protect nighttime users of the machines. Continuous monitoring of light levels at the ATM installation and its environs is therefore essential.

BRIEF DESCRIPTION OF THE INVENTION

Faced with the need for ATM lighting monitoring, we have found that monitoring of ATM lighting allows near instant response to lighting failures by closing the ATM machine until the lighting is corrected along with providing a warning to the customer while still at a safe distance that the ATM is out of service.

We have determined that once ATM lighting level is monitored at a central location, either within the branch bank or at a manned monitoring location away from the bank branch, other services may be monitored and controlled, as well, for more efficient operation of the branch. Examples of such other services which can be provided with the lighting alert system are:

a. A remote programmable time clock used to control all lights, signage, heating and air conditioning;
b. business machine unauthorized removal detection;
c. panic alarms for employees, in the bank or parking lot;

d. panic alarms for couriers (during off hours);
e. water leak detection;
f. detection of heating/air conditioning system failure; and
g. scheduled preventive maintenance for any systems.

The system which can provide all of these services comprises, basically:

1. a series of sensors for each environmental or other factor to be monitored;
2. a sensor signal data collection system, wired, optical or RF or a combination of such data collectors;
3. a data processing unit including stored programs and schedules as well as fault signal analysis processing to distinguish real from false alarms and incipient failures; and
4. an alerting system either local or at a distant monitoring system or both.

BRIEF DESCRIPTION OF THE DRAWING

This invention may be more clearly understood with the following detailed description and by reference to the drawings in which.

DETAILED DESCRIPTION OF THE INVENTION

Figure 1:
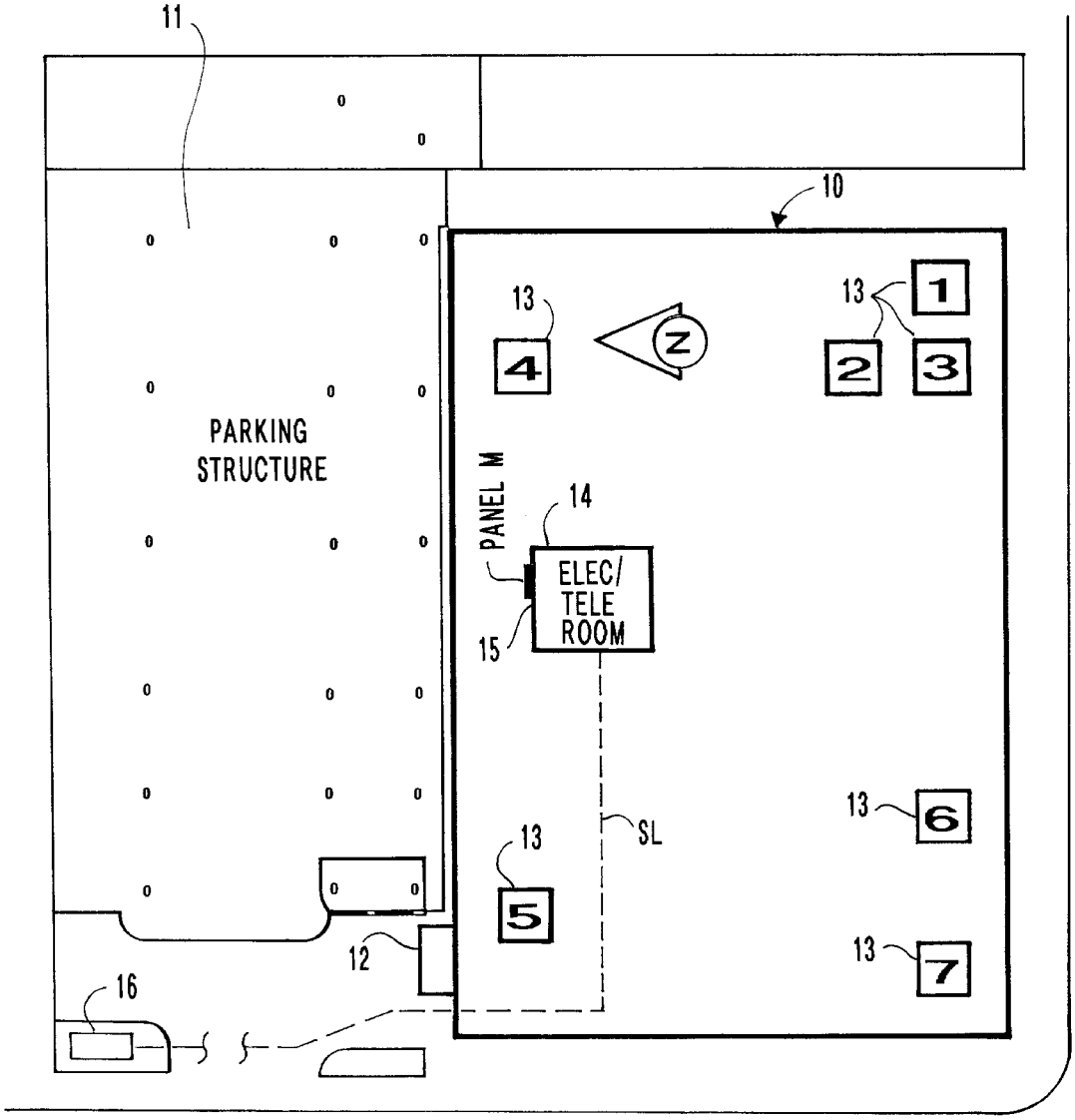
FIG. 1 is a layout of a typical commercial banking facility employing this invention.

As yet, the need for an integrated facility management system for single or satellite locations including light level monitoring and alarm, has not been recognized. Once having the capability of real time sensing of light levels and for control of an ATM installation and warning of customers has been accomplished, expansion of the system is possible. An example of such a system is disclosed below.

Now referring to the drawing FIGS. 1, 2 and 3, a typical installation of a commercial building employing this invention, namely a branch bank 10 and parking structure 11 with an external walkup Automatic Teller Machine, hereinafter ATM 12. As in a typical branch bank situation, the branch bank building 10 is free standing as in FIG. 1 or may be semi attached in a shopping mall or commercial strip center. The branch bank 10 will have a parking lot or parking structure 11 and sometimes a drive through route with either a live teller window or a second ATM installation operated by a driver/customer while in their vehicle.

In this case, a branch bank with a multi level parking garage 11 is depicted with a single walkup ATM 12 shown. The same principle of this invention may be applied to other branch bank arrangements or to other commercial facilities or businesses. The criteria for selection of the installation is that the business has any of the needs set forth above including customer's security lighting and the need to monitor and optimize energy consumption of the various occupancy related systems as heat/air conditioning and to detect and report abnormal conditions.

Typically, any such installation has an equipment center such as electrical/telephone room 14 of FIG. 1. This is the central location where, typically, telephone and data service is received and distributed within the building 10. Power controls are often located in the same or nearby room. Heating and air conditioning is commonly supplied by a single large Heating, Ventilating, Air Conditioning (HVAC) system as shown in FIG. 1 by a number of individual units 13 located above where needed and each having individual thermostats or sensors 33 (FIG. 2) for zone control of heating and cooling. Each may have separate gas lines but electrical supply for such units will often be from the electrical/telephone room 14. An electrical panel 15 is usually located outside of the room 14 so that occupants of the building may reset circuit breakers as needed, without gaining access to the full electrical system.

Recent requirements such as California AB 224 have specified minimum light levels for external ATM installations and require the businesses to provide a well lighted area at the ATM and in the adjacent approach paths for customer protection. Since most branch banks and commercial retail buildings are not occupied throughout each 24 hour period, a lighting failure may not be detected when it occurs and only by periodic inspections. 24 hour usage of ATM's is common so immediate detection of a lighting deficiency is essential. The presence of excess lighting will aid is maintaining minimum light levels but a total failure of lighting in the region might go undetected.

Figure 2:
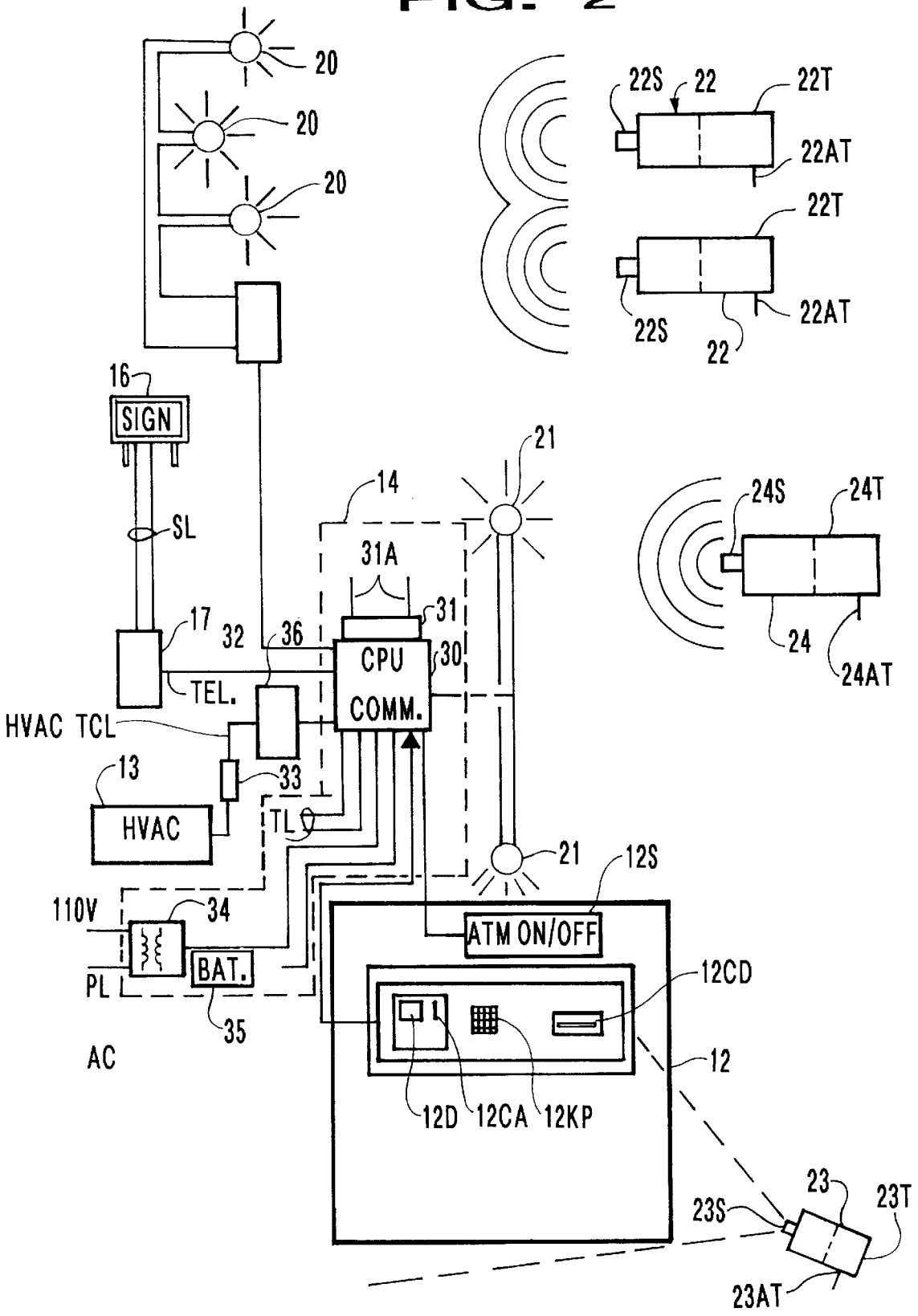
FIG. 2 is a block diagram of a system of this invention.

Employing this system as shown in FIG. 2 , the ATM 12 of FIG. 1 is lighted by a number of lamps 20 located so as to provide area lighting and an additional set of lamps 21 at or incorporated in the ATM 12 to provide immediate area lighting.

One or more area light level sensor assemblies 22 is directed at the area A covered by the lamps 20 and includes a light level sensor 22S and a wireless transmitter 22T, each transmitter with an internal or external antenna 22AT. An ATM light level sensor assembly 23 is directed at the ATM 12 and includes a light level sensor 23S with its associated wireless transmitter 23T and antenna 23AT.

The number and location of lamps 20 is designed to provide the minimum area light level of 2 candle power lumens at the sensor 22. The number and location of lamps 21 is designed to provide the minimum light level at the ATM 12 of 10 candle power at sensor 23.

Located within the room 14 or at other convenient location within the building 10 is a computer/communications module 30 which includes a wireless receiver 31 tuned to receive data from the transmitters 22T and 23T and sensor 25 as well as other sensors and components of this system as described below. In FIG. 2, the confines of room 14 are denoted by the dashed line 14.

An optional global area sensor 24 with its transmitter 24T is located exterior to the building 10 to observe ambient light level to establish a reference light level and act as back-up for the sensor 23.

The sign 16 shown in FIGS. 1 and 2 is powered via sign lines SL and interfacing relay 17 over a time clock controlled power line TEL from the CPU/Communicator module 30 within the room 14. A current sensor 32 may be coupled to the sign power line TEL to monitor sign lamp current. If the current drops or stops during time clock controlled lighted periods, a sign light failure is detected and registered. Sign lighting failure is not normally related to customer safety and therefore can be reported as an abnormality which should be remedied at the next work day. Any excess current draw may indicate a short circuit and the sensor 32 will then provide a signal which is interpreted at the CPU as a dangerous condition and causes an override of the time clock to remove power to the sign 16.

The HVAC units 13 are primarily controlled by their respective thermostats such as thermostat 33 which is located inside of the building 10 of FIG. 1 to sense the temperature in the zone served by the particular unit 13. As in a typical commercial installation, power to the HVAC units 13 is controlled by the thermostat 33 and an interfacing relay 36 which is controlled by a time clock via line HVAC TCL. In accordance with this invention, the line HVAC TCL terminates in the CPU/communicator unit 30 where its time clock is located. In accordance with this invention, the timing circuit of the CPU portion of the module 30 is used, thereby eliminating the need for numerous time clocks as in the usual commercial installation. In the event that a primary power outage is detected by the CPU of module 30, backup power is utilized to maintain proper timing in the system. This is in contrast with the typical commercial installation in which a power outage requires a manual resetting of all time clocks.

Figure 4:
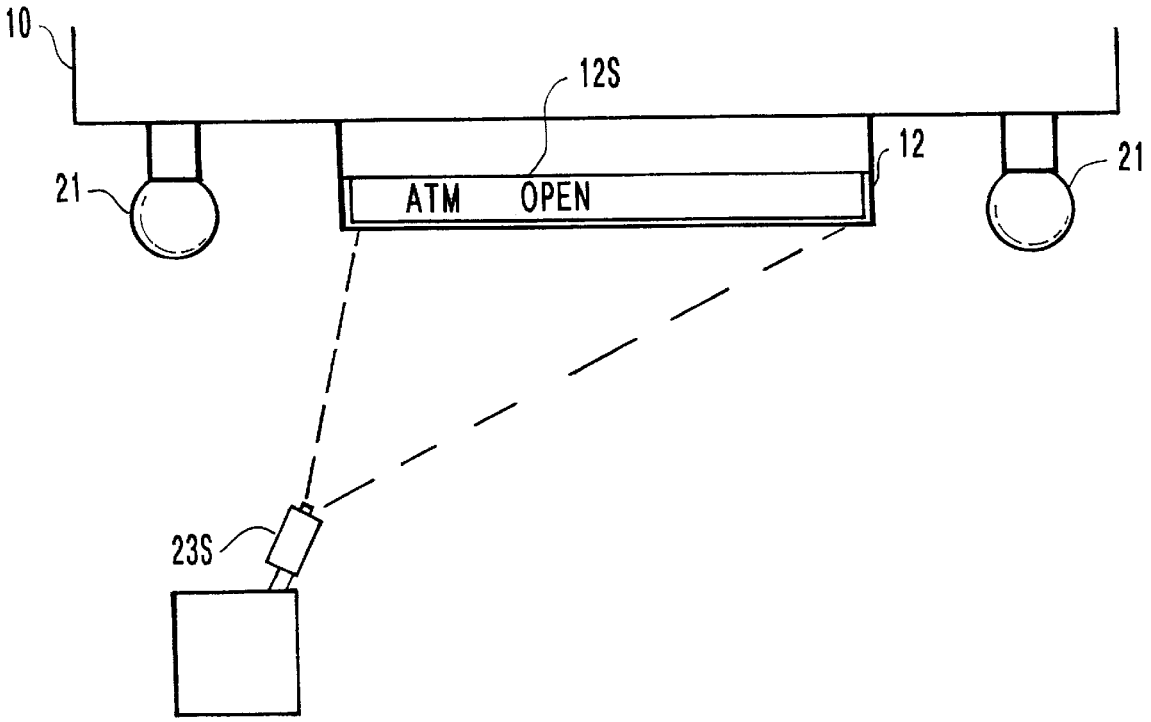
FIG. 4 is a top plan view of a typical ATM installation employing the lighting and monitoring features of this invention.

Referring again to FIG. 2 in connection with FIG. 4, the ATM 12 which is typically built in to an exterior wall of a branch bank building 10 includes a console 12C, display 12D, card acceptor 12CA, keypad 12KP and a currency dispenser 12CD. Sometimes the ATM will include an illuminated sign 12S to indicate whether the ATM is open or not. Other ATM's have mechanical covers for the display, keyboard and card accepter to prevent the use of the ATM during certain hours or under certain conditions.

This system is ideal for those systems employing an illuminated sign 12S which indicates whether the ATM is open or The sensor 23S which monitors the light level at the ATM 12 provided by lamps 21 is operative, when ambient light falls below the prescribed minimum at the ATM, to communicate with CPU 30 to disable the ATM and illuminate the ATM CLOSED sign. Depending upon the selection by the bank management, the ATM 12 may be closed when any one of the sensors 22 of FIG. 2 detects a light level in the general area below the accepted minimum.

Again referring to FIG. 2, the CPU/communicator module 30 is powered over the building 10 lines PL after voltage reduction to a suitable operating voltage such as 16.5 v. AC by transformer 34 and a suitable inverter(unshown) to provide DC power where required by the system. A backup or standby battery 35 is likewise provided in the equipment room 14 which is indicated in FIG. 2 by the dashed line surrounding the equipment which is normally located within that room when using the system of this invention.

Figure 5:
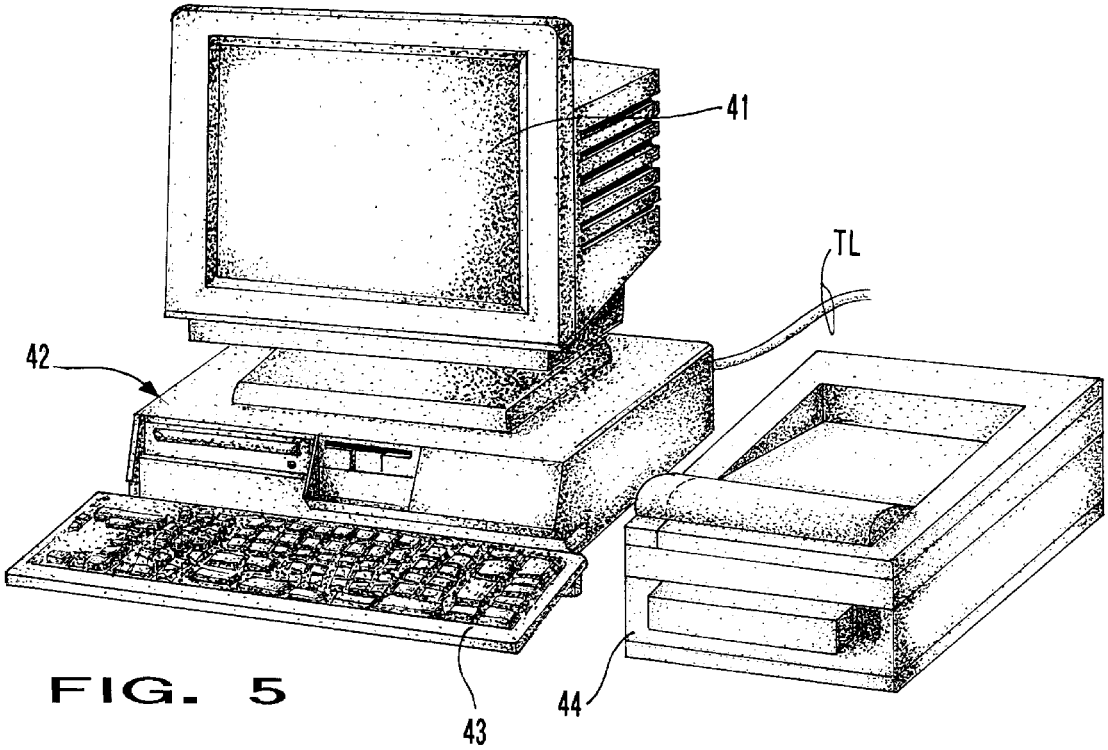
FIG. 5 is a perspective drawing of the central processing unit of this invention.
Figure 6:
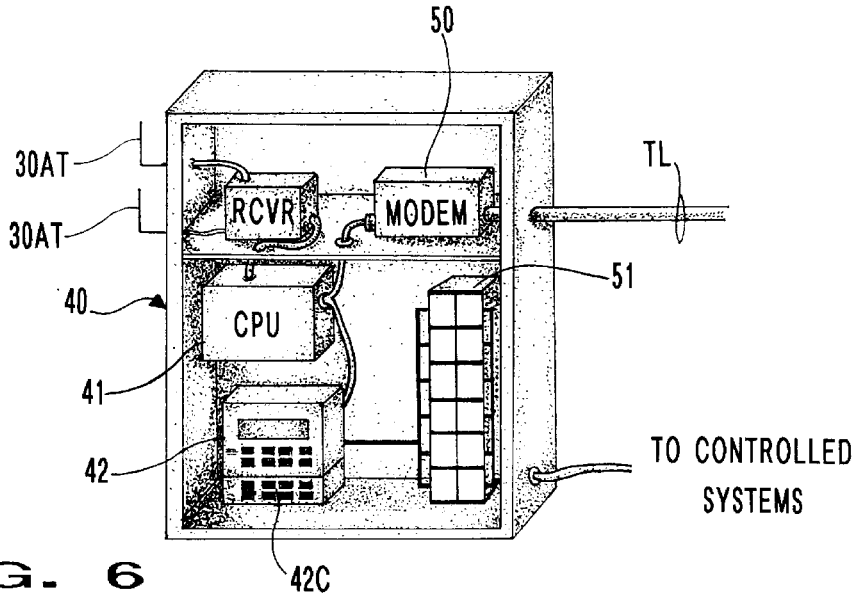
FIG. 6 is a perspective drawing of the communication/command module of this invention.

The CPU/Communication Module 30 of FIG. 2 is seen in more detail in FIGS. 5 and 6 as including a controller unit 40 (FIG. 7) of the type employed in security systems such as the Ranger 9000E Downloadable Control Communicator of Caddx-Caddi Controls, Inc. of Gladewater, Tex. This type of controller provides as many as 16 sensor inputs, 16 programmable outputs, 8 relay outputs, a basic 16 key keypad or a full English language keypad and a printer output. This unit may be used as the basic controller for the system or as alternatives, a separate CPU 41 may be present or a personal computer 42 may be used, relying upon the downloadable control communicator 40 only for its multi inputs and outputs and to a degree its programmable features. When a personal computer is used it should have, at least, the following:

IBM PC or compatible, XT or AT or higher

640K RAM, DOS 3.1 or higher, hard drive recommended

A full keyboard 43, a monitor 41 and a printer 44 are used to complete the personal computer system.

The communicator portion of module 30 includes a data modem 50 for the communication of information over telephone lines TL to a central monitoring office. Such office may be at a security company location or at a police station if the system incorporates security monitoring as well such as entrance protection or motion detection during closed hours.

The controller 40 also includes a bank of relays 51 under the control of either the CPU 41 or the control unit 42. In the embodiment of FIG. 6, the commercial controller unit identified above/below is preferred.

Figure 3:
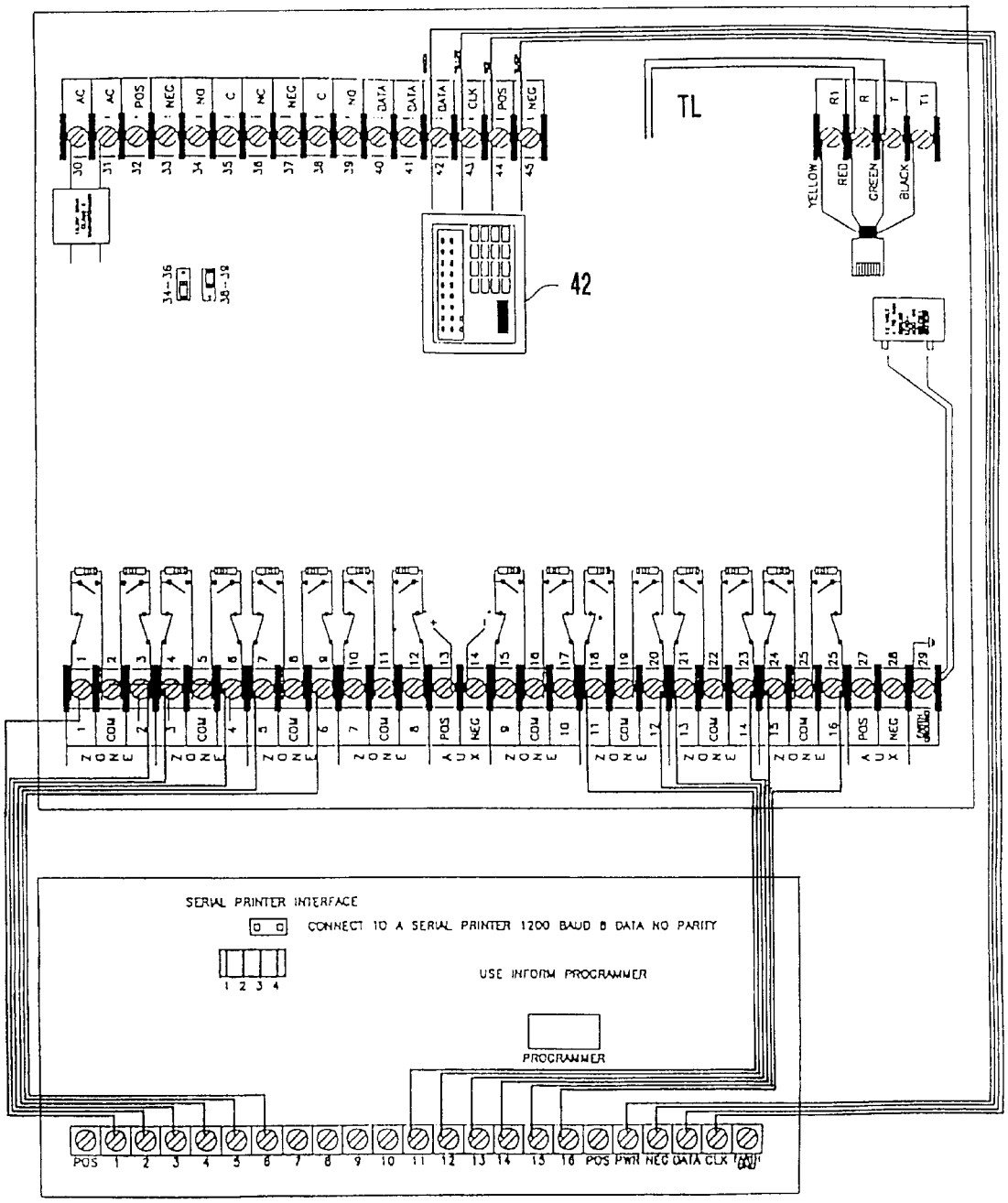
FIG. 3 is a main panel wiring diagram of the preferred embodiment.

A simplified system is illustrated in FIG. 3 in which the same reference numerals utilized in FIGS. 1 and 2 are found in FIG. 3 to represent the same components of the system.

The functions of this invention may be carried out employing certain off the shelf equipment which when configured in accordance with this teaching can provide many of the functions. Specially designed equipment includes the sensor/transmitter combination. Some of the standard equipment which may be used for certain functions of this invention include:

Controller Unit 4-2

Ranger 9000E Downloadable Control/Communicator
of Caddx-Caddi Controls, Inc. Gladewater, Texas 75647
FA 200 Universal Transmitter
FA210 Reduced Size Universal Transmitter
FA400 Remote Receiver by Inovonics Corporation
of Boulder, Colorado 80301

Sensors

Hawkeye 5800 Mini Sensor
Hawkeye 5900 Split-Core Sensor
Hawkeye 5002 Remote Status Current Sensing Panel
by Veris Industries,
1-800-354-8556 of 10799 S.W.
Cascade Blvd., Portland, Oregon 97223

Figure 7:
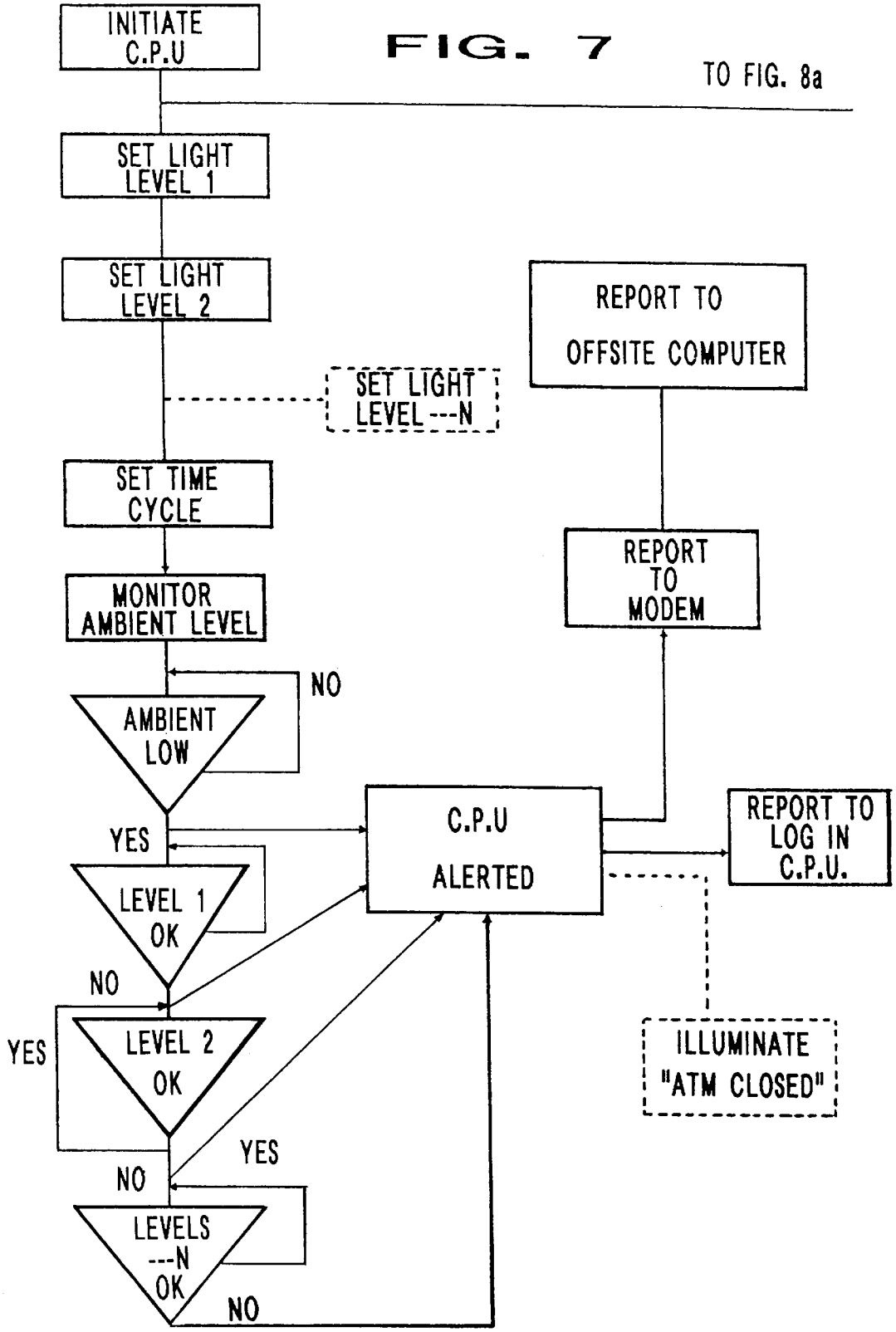
FIG. 7 is a flow diagram of the ATM light level monitoring process of this invention.
Figure 8A:
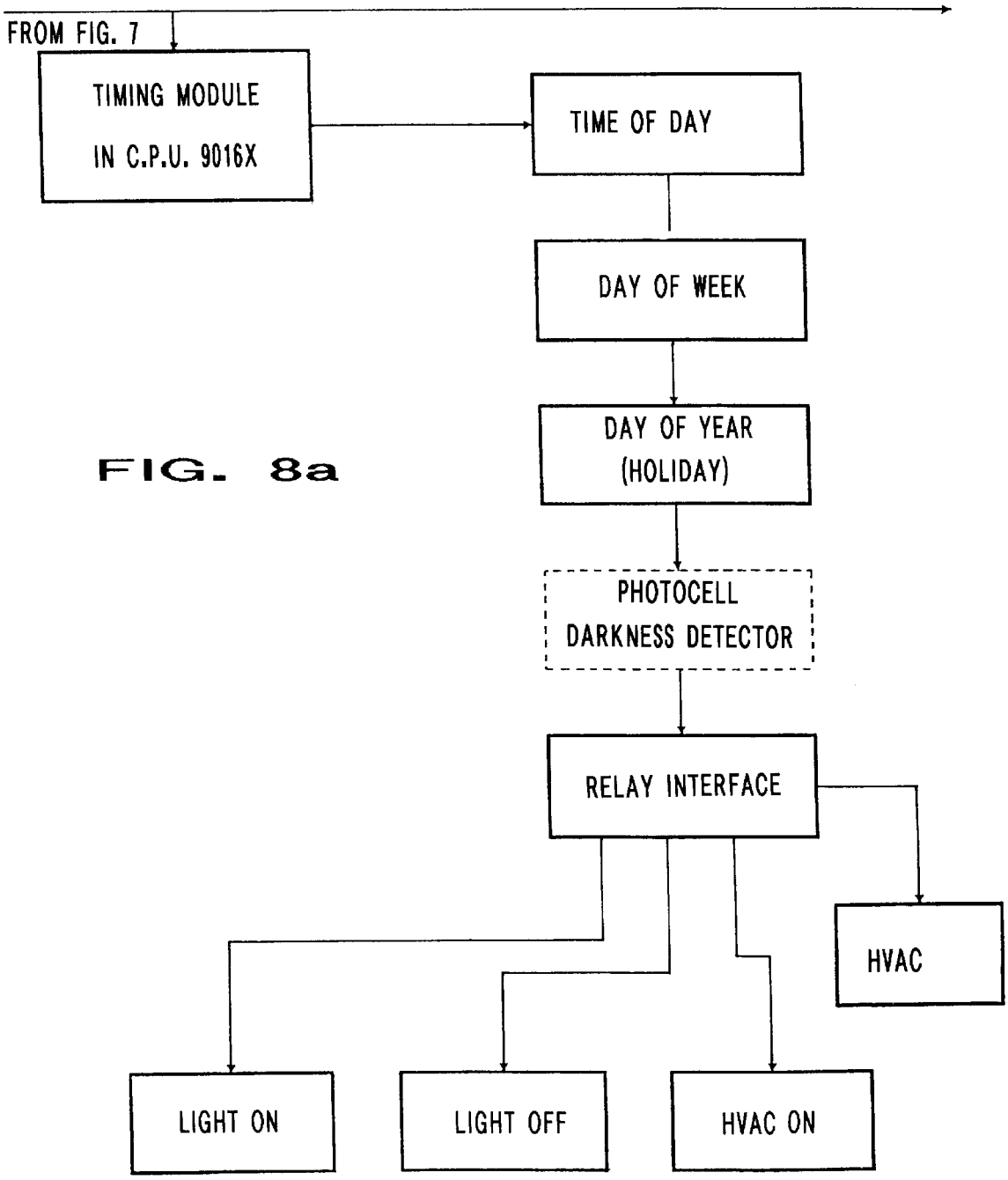
FIGS. 8*a* and 8*b* are flow diagrams constituting extensions of FIG. 7 and show additional monitoring features of this invention.
Figure 8B:
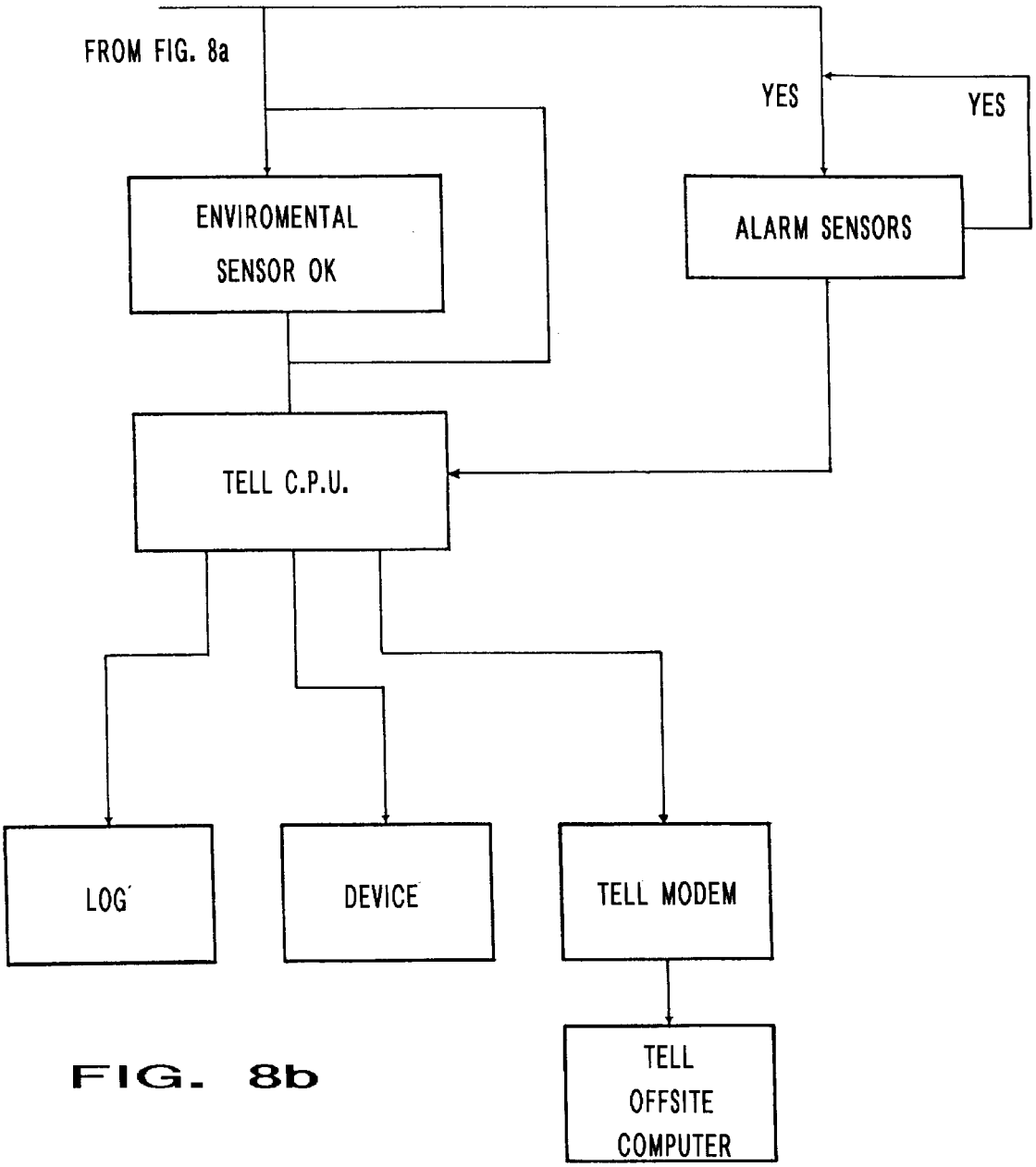

Now refer to FIGS. 7, 8*a* and 8*b*, which constitute a series of flow diagrams to illustrate the operation of the system. In FIG. 7 the sequence for light level monitoring at an ATM is shown. First, the CPU proceeds with its normal initialization routine which is established as part of the normal CPU setup and is dictated by the computer chosen and its operating system and subsystems used. Next, the first step for operation of the particular sensing system is the setting of the primary or light level 1 setting. This can be performed using the keyboard 43 of FIG. 5 or the controller units 42C of FIG. 6. The primary or light level 1 is the level as sensed by the sensor 23 of FIG. 2 which senses the level of illumination directly at the face of the ATM and within 5 feet of the ATM.

Next, the desired or required light level is set at the general area within 50 feet of the ATM which is designated as level 2. Optionally, other areas such as a parking lot near the ATM is set as light level 3 or 4. This step is shown in dashed lines between setting light level 2, and setting the time cycle. The schedule or programming for hours of illumination for the ATM and regions covered by sensors 22S and the optional sensor 23S are next set. This will normally include the schedule of operating hours for normal lighting. If the ATM is to be illuminated at level 1, whenever needed by reason of the ambient level falling below a standard, the schedule setting is unnecessary. The ambient light level is sensed. The light level 1 is monitored and if found to be below the stored standard, the ATM is closed and the ATM CLOSED light optionally is illuminated.

If light level 2 is sensed as being below the standard level of illumination, the same action occurs. The date and time of sensing insufficient illumination is recorded in memory of the CPU and the occurrence printed as a discrepancy by the printer 44 of FIG. 6.

FIGS. 8*a* and 8*b* are extensions of the flow diagram of FIG. 7 and illustrate the sequence for each of several other discrepancies such as:

(a) sign lighting current too low;

(b) heating/air conditioning system operation outside of standards;

(c) lighting control;

(d) water leakage detection;

(e) employee panic alarm operation; and (f) courier panic alarm operation.

The computer program is the DL900 Ranger Upload/Download Program, Ver. 3.76 of Caddx-Caddi Controls, Inc. of Gladewater, Tex. 75647 which accompanies their RANGER Model 9000E Downloadable Control/Communicator.

The above described embodiments of the present invention are merely descriptive of its principles and are not to be considered limiting. The scope of the present invention instead shall be determined from the scope of the following claims including their equivalents.

Reference is hereby made to Documention Programming and Interpretation Manual accompanying this application as Exhibit A.

What is claimed is:

1. A system for monitoring and responding to variations in light levels from a predetermined level of the surroundings adjacent an exteriorly located consumer operated installation to insure adequate consumer light level protection comprising:

light sensing means for sensing a light level in the immediate area of said installation;

light sensing means for sensing at least one other light level in a surrounding area, said light sensing means including comparing means for comparing said sensed light levels with at least two specified minimum values and means for transmitting only signals representative of light values below either of said specified minimum values; and a central data processing unit including a clock, receiving means for receiving said transmitted signals and communication means operative in response to reception of said transmitted signals for communicating the existence of said transmitted signals to a remote location.

2. A system as claimed in claim 1 further comprising means operative in response to at least one of said transmitted signals for disabling said installation.

3. A system as claimed in claim 2 further comprising means responsive to said clock for limiting the operating hours during which said central data processing unit responds to said transmitted signals to disable said installation.

4. A system as claimed in claim 2 comprising alerting means at said installation for signalling to prospective consumer user that the installation is disabled.

5. A system for monitoring and responding to variations in ambient light levels from predetermined levels of the surroundings adjacent an exteriorly located consumer operated installation to insure adequate consumer light level protection comprising:

light sensing means for sensing at least two levels of lighting values including one level of lighting values in the immediate area of said installation and second light sensing means for sensing levels of lighting values in the area surrounding the installation including wireless means for transmitting signals in response to sensed lighting levels only below either of said lighting values;

a central data processing unit including a clock, means for receiving said wireless transmitted signals and means operative in response to reception of said transmitted signals for disabling said installation.

6. A system as claimed in claim 5 wherein said installation is an automatic teller machine and said system further includes alerting means detectable by a consumer outside of the immediate area of the machine and means responsive to said transmitted signals for alerting prospective consumer users that said machine is disabled.

7. A system as claimed in claim 6 wherein said alerting means comprises a lightable sign.

8. A system as claimed in claim 5 further comprising means responsive to said clock for limiting the operating hours during which said central data processing unit responds to said transmitted signals to disable said installation.

9. A system as claimed in claim 5 further comprising an additional sensor, transmitter means connected to said sensor for communicating an additional signal representative of another sensed condition at said sensor;

means in said central data processing unit for comparing the signal with stored data representing a desired value of said other sensed condition and producing a deviation signal representing the deviation of said additional signal from said desired value of said other sensed condition; and means for communicating said deviation signal to a remote location.

10. A system for monitoring and responding to variations in light levels from predetermined levels of the surroundings adjacent an automatic teller machine to insure adequate consumer light level protection comprising:

light sensing means for sensing at least two levels of lighting values in the area of said machine including wireless transmitting means for transmitting signals only in response to sensed lighting levels below either of said lighting values;

a central data processing unit including a clock, wireless signal receiving means for receiving said transmitted signals, means responsive to said clock for controlling operating hours of the system, a communications channel responding to reception of said transmitted signals for communicating reception of said signals to a manned location, and means responsive to reception of said transmitted signals for disabling said machine; and a lightable sign illuminated in response to disabling of said machine and operative in response to a resumption of lighting above said lighting values for terminating the illumination of said sign and for re-enabling said machine.

11. A system in accordance with claim 6 wherein said system is operative upon detection of a resumption of lighting above said lighting values for terminating the illumination of the sign and for re-enabling the installation.

12. A system in accordance with claim 1 wherein said central data unit is located within said business environment and includes a communications channel to a manned location for communicating the existence of said transmitted signals.

13. A system in accordance with claim 1 including display means for providing a visual record of said transmitted signals occurring during a preselected period of time.

14. A system in accordance with claim 1 wherein said central data unit includes means for programming the monitoring of said light sensing means to correspond to variable schedules.

15. A system in accordance with claim 2 wherein said central data unit includes means for responding to the light sensing means corresponding to variable schedules.

* * * * *